US008171761B2

(12) United States Patent
Kidd

(10) Patent No.: US 8,171,761 B2
(45) Date of Patent: May 8, 2012

(54) LOCKING DEVICE FOR SECURING ARTICLES FOR DISPLAY

(75) Inventor: Christopher Kidd, New York, NY (US)

(73) Assignee: Lloyd, Gerstner & Partners, Paramus, NJ (US)

( * ) Notice: Subject to any disclaimer, the term of this patent is extended or adjusted under 35 U.S.C. 154(b) by 0 days.

(21) Appl. No.: 12/639,618

(22) Filed: Dec. 16, 2009

(65) Prior Publication Data

US 2010/0155265 A1 Jun. 24, 2010

Related U.S. Application Data

(60) Provisional application No. 61/122,983, filed on Dec. 16, 2008.

(51) Int. Cl.
*E05B 65/00* (2006.01)

(52) U.S. Cl. ..... 70/57.1; 70/58; 70/232

(58) Field of Classification Search ..... 70/18, 19, 70/57, 57.1, 58, 59, 60, 61, 232
See application file for complete search history.

(56) References Cited

U.S. PATENT DOCUMENTS 4,438,642 A * 3/1984 De Jong ..... 70/232
5,119,652 A * 6/1992 Costa ..... 70/57.1
5,144,820 A * 9/1992 Holmgren ..... 70/57.1
5,421,177 A * 6/1995 Sieber et al. ..... 70/57.1
5,655,392 A * 8/1997 Holmgren ..... 70/57.1
6,044,674 A * 4/2000 Rushing et al. ..... 70/232
6,317,046 B1 * 11/2001 Fresnel et al. ..... 70/57.1
6,374,647 B1 * 4/2002 Holmgren ..... 70/57.1
7,602,297 B2 * 10/2009 Marsilio et al. ..... 70/57.1
2005/0211658 A1 * 9/2005 Bagration De Ulloa ..... 70/57.1

* cited by examiner

*Primary Examiner* — Suzanne Barrett
*Assistant Examiner* — Christopher Boswell
(74) *Attorney, Agent, or Firm* — Cozen O'Connor

(57) ABSTRACT

A locking device is provided and operable to retain an article intended for display and handling in a designated area. In particular, the locking device is formed with an adjustable fastening loop, which can assume an extended position to receive a free end or a portion of the article, and a retracted position to secure the article in the fastening loop. The fastening loop can be adjusted between the extended position and the retracted position, so that the locking device is adapted to receive and secure articles of various sizes. The locking device is preferably mounted to a fixture, such as a display table or counter via a tether cable. When the cable is mounted to the fixture, the locking device is capable of retaining an article in the designated area and preventing the article from being removed from the designated area. For example, the locking device can secure a sample item to a designated area, such as a display counter in a retail store.

20 Claims, 7 Drawing Sheets

FIG. 2C
FIG. 2F
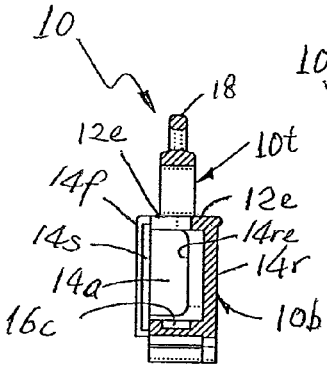
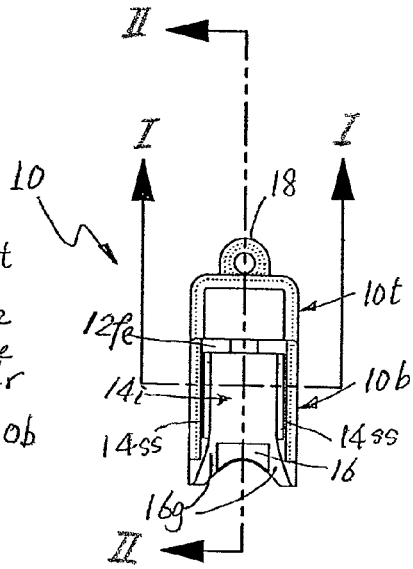
FIG. 2A
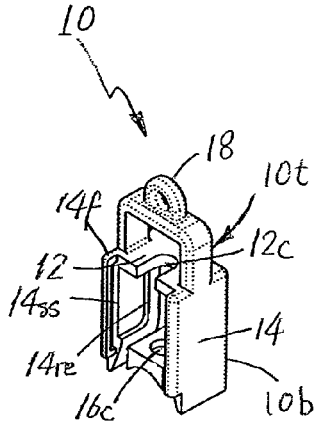
FIG. 2D
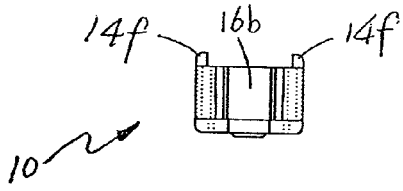
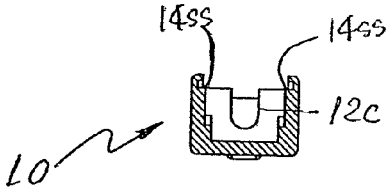
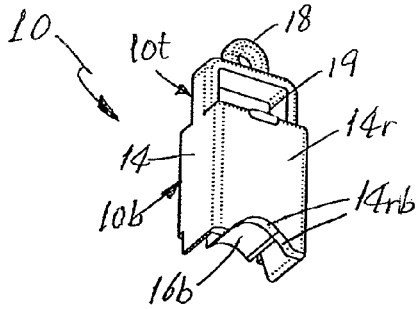
FIG. 2B
FIG. 2E

LOCKING DEVICE FOR SECURING ARTICLES FOR DISPLAY

CROSS-REFERENCE TO RELATED APPLICATION

This patent application claims priority from U.S. Provisional Patent Application No. 61/122,983 filed Dec. 16, 2008, the entire content of which is incorporated herein by reference.

FIELD OF THE INVENTION

The present invention relates generally to a locking device to be secured to various articles for display, such as in a retail store. More specifically, the present invention relates to a locking device and, in particular an adjustable locking device, operable to retain various articles, such as a sample item, in a display area to allow consumers access to the sample item while reducing the threat of theft of the sample item.

BACKGROUND OF THE INVENTION

Merchants and retailers often display samples of merchandise. Sample items allow customers to inspect the actual product removed from packaging and even perform trial use of the product. For example, sample pens are placed on display in stationery stores for consumers to inspect and demonstrate before purchasing.

Display samples of small items such as pens and portable electronic devices (e.g., cameras, PDA's, mobile phones, music players, etc.) are often misplaced, lost or stolen. Replacement of missing sample items can cause merchants and retailers additional cost because those sample items will need to be replaced. Although various attempts have been made to secure merchandise still remaining in packaging such as behind locked glass casings, sample items on display are often left unguarded. Consequently, it is desirable to provide consumers access to display items while preventing such items from being misplaced or stolen.

The various embodiments described herein afford a solution to the above mentioned problems while allowing merchants to continue to display sample merchandise.

SUMMARY OF THE INVENTION

A locking device is disclosed herein which is operable to retain an article in a designated area. In particular, the locking device is formed with an adjustable fastening loop, which can assume an extended position to receive a free end or a portion of the article, and a retracted position to secure the article in the fastening loop. The fastening loop can be adjusted between the extended position and the retracted position so that the locking device is adapted to receive and secure articles of various sizes.

The locking device is preferably mounted to a fixture, such as a display table or counter via a tether cable. When the cable is mounted to the fixture, the locking device is capable of retaining an article in the designated area and preventing the article from being removed from the designated area. For example, the locking device can secure a sample item to a display counter in a retail store.

In one embodiment, the locking device includes a housing unit, an adjustment mechanism supported inside the housing unit, and a securing strap attached to the adjustment mechanism and partially extending outside of the housing unit. The securing strap and the housing unit form an enclosed loop outside of the housing unit for receiving the article intended for display and for selectively securing and releasing the article to/from the housing unit. The adjustment mechanism is configured to expand or contract the securing strap between a releasing position and a securing position, respectively.

The locking device also includes a cap configured to releasably lock to the housing unit to contain the adjustment mechanism between the cap and the housing unit. When the cap is locked to the housing unit, the cap prevents access to the adjustment mechanism.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The following description is set forth in connection with the attached figures, which are not necessarily to scale, emphasis instead generally being placed upon illustrating the principles of the invention. In the drawings:

FIG. 2A is a front perspective view of a rear housing of the locking device;

FIG. 2B is a rear perspective view of the rear housing shown in FIG. 2A;

FIG. 2C is the front view of the rear housing shown in FIG. 2A;

FIG. 2D is the bottom view of the rear housing shown in FIG. 2A;

FIG. 2E is a cross-sectional view of the rear housing taken along line in FIG. 2C;

FIG. 2F is a cross-sectional view of the rear housing taken along line II-II in FIG. 2C;

DETAILED DESCRIPTION OF THE EMBODIMENTS

The various embodiments herein illustrate a locking device 1 operable for retaining an article in a designated area and preventing the article from being removed from the designated area. In the following descriptions, same or similar elements or components are designated with the same numeral references; redundant description is omitted.

Figure 1B:
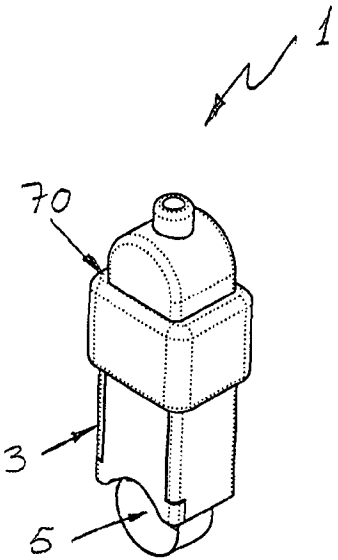
FIGS. 1A and 1B are perspective views of a locking device in, respectively, an exploded state and assembled state.
Figure 1A:
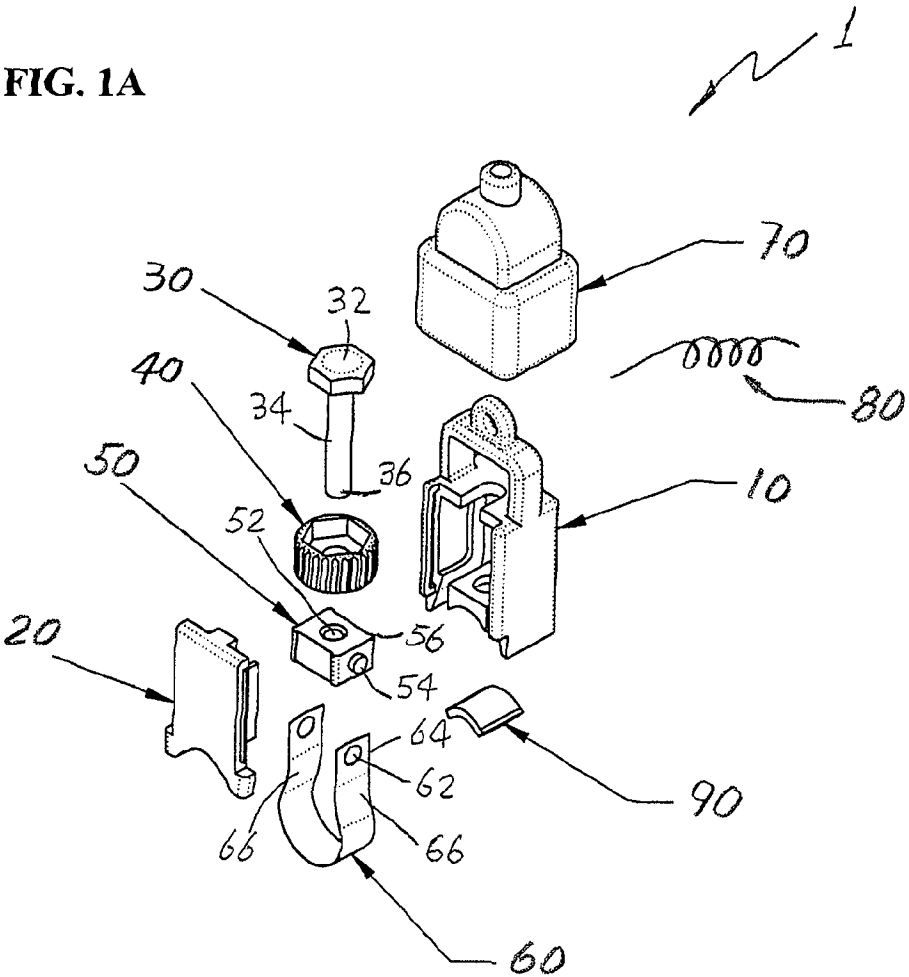
Figure 6A:
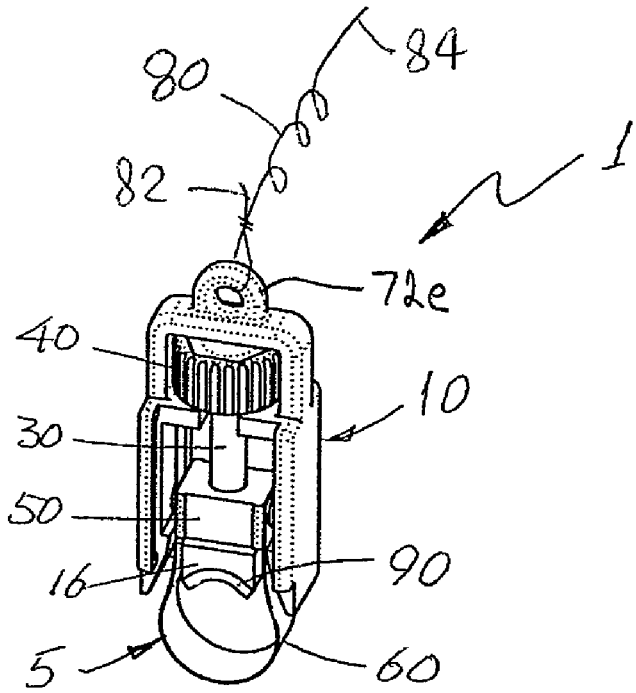
FIGS. 6A and 6B are perspective views of a partially assembled locking device in respectively locked and unlocked positions.
Figure 6B:
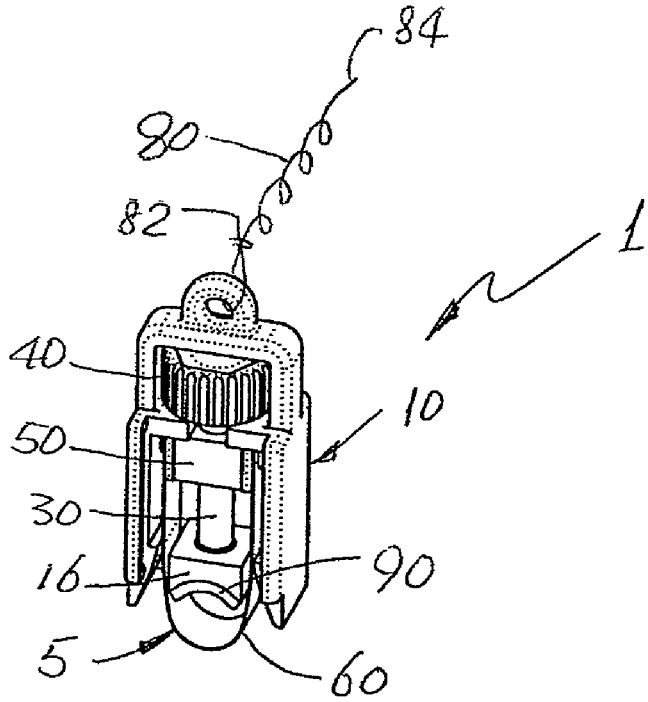

FIGS. 1A and 1B show an example of a locking device 1 in respectively exploded state and assembled state viewing from a front side toward a rear side of the locking device 1. As is shown in FIG. 1A, the locking device 1 has a housing unit 3 formed by two housings, namely, a rear housing 10 and a front housing 20, configured to be joined to each other. The housing unit 3 encloses and supports adjustment components, including a screw 30, an adjustment knob 40, and a block 50, as also shown in FIGS. 6A and 6B and described below.

These adjustment components 30, 40, 50 of the locking device 1 are interconnected to form an adjustment mechanism. For example, the screw 30 can have its screw head 32 fitted inside a receiving area 42 of the adjustment knob 40, to thereby rotate along with the adjustment knob 40. In addition, the threaded screw shaft 34 can freely pass through a receiving hole 44 in the adjustment knob 40 and engage a threaded hole 52 in the block 50. Rotation of the knob 40 causes linear movement of the block 50 along a longitudinal axis of the device (along line II-II in FIG. 2*c*) by the threaded screw shaft 34, as described below.

The adjustment mechanism 30, 40, 50 of the locking device 1 is used to control a securing strap 60, and adjust its position in relation to the housing unit 3 between a contracted locking position and an expanded or unlocking position. For example, the securing strap 60 has ends 64 configured to be secured to the block 50. When the block 50 is moved by manipulation of the threaded screw shaft 34, the securing strap 60 will move with the block 50 between the locking position to secure an article to the locking device 1, and the unlocking position to release the article from the locking device 1.

The locking device 1 also includes a cap 70 lockable to the housing unit 3. When the cap 70 is locked onto the housing unit 3, the cap 70 will cover the housing unit 3, as well as the adjustment mechanism 30, 40, 50, thereby preventing unauthorized access to the screw 30, the adjustment knob 40, and the block 50 of the adjustment mechanism.

It is preferred that a connecting cable 80 is provided such that one cable end 82 is attached to the housing unit 3 and the other cable end 84 is attached to a permanent fixation, such as a display shelf or counter, thereby securing the locking device 1 to the permanent fixation. In one example, the cable end 82 is concealed or locked inside the cap 70 in the locking position of the locking device 1, thereby preventing the cable end 82 from unauthorized access and being detached from the locking device 1. The connecting cable 80 can be a retractable cable, as is known in the art.

As shown in FIG. 1B, when the locking device 1 is assembled, access to the adjustment components 30, 40, 50 is restricted—except to authorized personnel—thereby preventing customers from removing the locking device 1 from an attached display item and, consequently, preventing pilfering of the display item.

The various above mentioned components of the locking device 1 as well as its assembly and operation will be described in greater detail below.

FIGS. 2A to 2F show various views of the rear housing 10 of the locking device 1 for at least partially supporting the screw 30, adjustment knob 40, block 50, and securing strap 60. The rear housing 10 is divided into an upper or top housing portion lot and a lower or bottom housing portion 10*b* by a dividing wall 12. The upper housing portion 10*t* is formed to accommodate and support the adjustment knob 40 in the assembled locking device 1. In one example, the upper housing portion 10*t* opens both in the front and back, allowing access of the adjustment knob 40 during the locking and unlocking operation of the locking device 1. In the example shown in FIG. 1A, the upper housing portion 10*t* has a reduced depth so that the adjustment knob 40 can extend beyond the upper housing portion 10*t* in the front and/or at the back for easy manipulation, as is shown in FIGS. 6A and 6B.

Additionally or alternatively, the upper housing portion 10*t* of the housing unit 3 can be configured and positioned to expose part of the upper surface 12*e* of the dividing wall 12 both in the front and at the back. The exposed parts 12*e* of the dividing wall 12 can interact with the cap 70 and provide additional support to the cap 70 in the assembled locking device 1, as will be described in detail below.

Figure 4A:
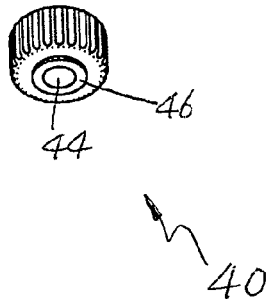
FIG. 4A is a perspective view of an adjustment knob of the locking device.
Figure 4B:
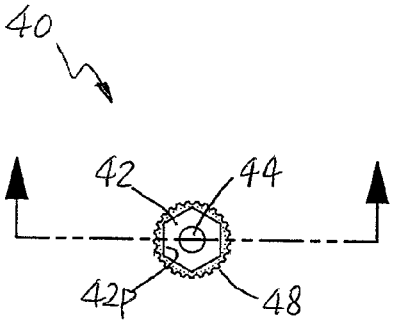
FIG. 4B is the front view of the adjustment knob shown in FIG. 4A.
Figure 4C:
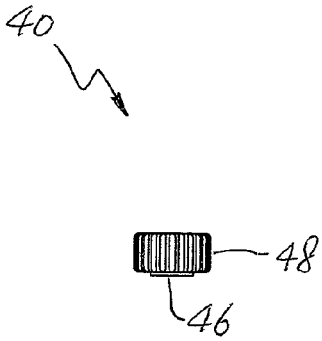
FIG. 4C is the top view of the adjustment knob shown in FIG. 4A.
Figure 4E:
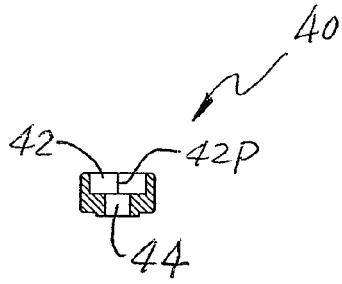
FIG. 4E is a cross-sectional view of the adjustment knob taken along line in FIG. 4B.
Figure 4D:
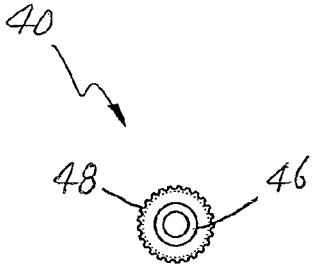
FIG. 4D is the bottom view of the adjustment knob shown in FIG. 4A.

The dividing wall 12 of the rear housing 10 is formed with a cutout 12*c* extending from the front edge 12*fe* of the dividing wall 12. The cutout 12*c* allows the screw shaft 34 of the screw 30 to enter the cutout 12*c* from the front edge 12*fe* of the dividing wall 12 and be received in the cutout 12*c*. In one example best shown in FIGS. 2C and 2E, the cutout 12*c* is aligned with a center axis of the housing unit 3, which center axis is illustrated by the double-dot dash line in FIG. 2C. In one example, the screw shaft 34 received in the cutout 12*c* also aligns with the center axis. In another example, part of the cutout 12*c* is sized to accommodate a ring structure 46 (FIG. 4A) on the adjustment knob 40 to thereby position the adjustment knob 40 in the assembled locking device 1.

The lower housing portion 10*b* of the rear housing 10 defines a substantially enclosed chamber 14*i* for housing and supporting the screw shaft 34, the block 50, and the securing strap 60 therein. In one example, the lower housing portion 10*b* can include an integrally formed dividing wall 12, sidewalls 14, rear wall 14*r*, and base 16. The lower housing portion 10*b* can open in the front to allow the screw shaft 34, the block 50, and the securing strap 60 to enter the lower housing portion 10*b* from the front.

The sidewalls 14 of the lower housing portion 10*b* are each formed with a concave portion 14*a* inside the enclosed chamber 14*i* to accommodate at least part of the block 50 during the assembling and operation of the locking device 1. For example, the concave portion 14*a* in the sidewalls 14 accommodate strap supporters 54 formed on opposite sides of the block 50 for attaching to the ends of the securing strap 60, as will be described in greater details below. In one example, the concave portions 14*a* of the sidewalls 14 are spaced apart for a sufficient distance to accommodate the lateral dimension of the block 50 between its strap supporters 54. In another example, each concave portion 14*a* on the respective sidewall 14 can extend substantially throughout the entire sidewall 14 in an axial direction. The concave portions 14 allow the block 50 to travel inside the lower housing portion 10*b* in the axial direction during the locking and unlocking operation of the locking device 1, as is shown in FIGS. 6A and 6B.

In another example, each concave portion 14*a* on the respective sidewall 14 extends from the front of and into the lower housing portion 10*b*, allowing the block 50 to enter the lower housing portion 10*b* from the front. In the example shown in FIG. 2F, each concave portion 14*a* can end by a rear edge 14*re* extending in the axial direction of the rear housing 10. The rear edge 14*re* can limit the strap supporters 54 on the block 50 from undesired lateral movement and, thus, causes the block 50 to move in the axial direction during the locking and unlocking operation of the locking device 1 as is illustrated in FIGS. 6A and 6B.

As FIGS. 2A and 2B show, each sidewall 14 of the lower housing portion 10*b* can have a connecting structure for joining with the front housing 20. In the example shown in FIG. 2A the sidewalls 14 each include a thinned front end portion 14*f*. The front end portions 14*f* can be formed with respective axial slots 14*s* facing toward each other. The axial slots 14*s* on the sidewalls 14 of the rear housing 10 are configured to receive respective inserts 22 on the front housing 20 and join the front and rear housings 10, 20 to each other.

Figure 7B:
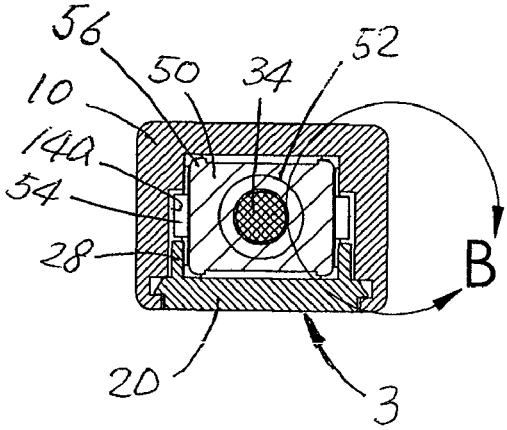
FIG. 7B is a cross-sectional view of the assembled housing unit taken along line VI-VI in FIG. 7A.

In another example, the front end portions 14*f* of the sidewalls 14 can extend toward the front beyond the dividing wall 12 for a distance substantially the same as the thickness of the front housing 20. In this example, the housing unit 3 formed by the front and rear housings 10, 20 can have a smooth exterior, as shown in FIG. 7B.

In a further example as is best shown in FIGS. 2A and 2E, the front end portions 14*f* of the sidewalls 14 are thinner than the sidewalls 14 at the concave portions 14*a*, resulting in a stepped surface 14*ss*. When the front and rear housings 10, 20 are connected to each other, part of the inner surface 20*i* (FIGS. 3A and 3D) of the front housing 20 can rest against and thereby be supported by the stepped surface 14*ss* on the rear housing 10.

The lower housing portion 10*b* includes a base 16, which can extend from and be integrated with the rear wall 14*r* of the lower housing portion 10*b* as is shown in FIG. 2F. The base 16 of the lower housing portion 10*b* can provide support to one or more interconnected adjustment components. In one example, the base 16 is formed with a concave portion 16*c* to support the screw shaft 34 in the assembled locking device 1. For example, the concave portion 16*c* on the base 16 has a cylindrical circumference to accommodate the end portion 36 of the screw shaft 34 as is shown in FIGS. 6A and 6B. In one example, the concave portion 16*c* can be positioned to align with the cutout 12*c* in the axial direction of the rear housing 10.

As is shown in FIG. 2C, the base 16 of the lower housing portion 10*b* is spaced away from the sidewalls 14 on both sides resulting in a gap 16*g* between the base 16 and a respective sidewall 14. The gaps 16*g* are configured to allow the ends 66 of the securing strap 60 to pass therethrough during the assembling and operation of the locking device 1 as is best shown in FIGS. 6A and 6B.

Additionally, the base 16 forms a part of a fastening loop 5—the remainder of which is defined by the securing strap 60—for securing a portion of the display article. In one example best shown in FIGS. 2A and 2B, the bottom surface 16*b* has a curved shape adapted to receive a curved surface of the display article against the securing strap 60 as is shown in FIGS. 6A and 6B, thereby securing the article in the fastening loop 5. In the example shown in FIG. 2B, the rear wall 14*r* of the lower housing portion 10 can be formed with a similarly curved bottom edge 14*rb* to increase the contacting area between the fastening loop 5 and the display article.

The rear housing 10 is configured to receive a connecting cable 80. In one example, an eye fastener 18 can be formed on the rear housing 10, such as on the upper housing portion 10*t*. The eye fastener 18 can receive an end of the connecting cable and allow the same to be mounted onto the eye fastener 18. As one skilled in the art will appreciate, other fasteners can be formed and positioned at different locations on the housing unit 3 to allow attachment to an end of a tether or cable.

FIGS. 3A to 3D show various views of the front housing 20 of the locking device 1. In one example, the front housing 20 is configured to cover the opening of the rear housing 10 and thereby enclose and conceal the various adjustment components inside the assembled housing unit 3. As is illustrated in FIGS. 1B and 7B, the housing unit 3 can have a smooth and continuous external appearance without clear distinction between the front and rear housings 10, 20 so that any seam between the front and rear housings 10, 20 will be difficult to discern.

The front housing 20 of the locking device 1 can be configured to be connected with the rear housing 10 to form a continuous housing unit 3 of the locking device 1. In one example, the front housing 20 is formed with inserts 22 on both sides. The inserts 22 are configured to fit into the axial slots 14*s* in the front end portions 14*f* of the rear housing 10. As FIG. 3A shows, the inserts 22 each can have a tapered surface 22*t*, which can facilitate fitting the inserts 22 into the axial slots 14*s* in the rear housing 10 when assembling the locking device 1.

Additionally or alternatively, the front housing 20 of the locking device 1 can be configured to be in additional contact with the lower housing portion 10 in the assembled locking device 1. For example, the inner surface 20*i* of the front housing 20 can be adapted to contact one or more portions of the rear housing 10 in the assembled locking device 1 for support. In one example, the inner surface 20*i* can be supported by the front edge 12*fe* of the dividing wall 12. In another example, the inner surface 20*i* can be supported by the stepped surface 14*ss* on the rear housing 10. For example, the front housing 20 has laterally extending portions 24 formed at the bottom for contacting with parts of the stepped surface 14*ss* near the bottom of the rear housing 10.

Such additional direct contact between the front and rear housings 10, 20 can improve the rigidity of the assembled locking device 1. For example, the front housing 20 can be prevented from being pushed into the lower housing portion 10*b* of the rear housing 10, thereby preventing unauthorized access to the adjustment components.

Figure 3A:
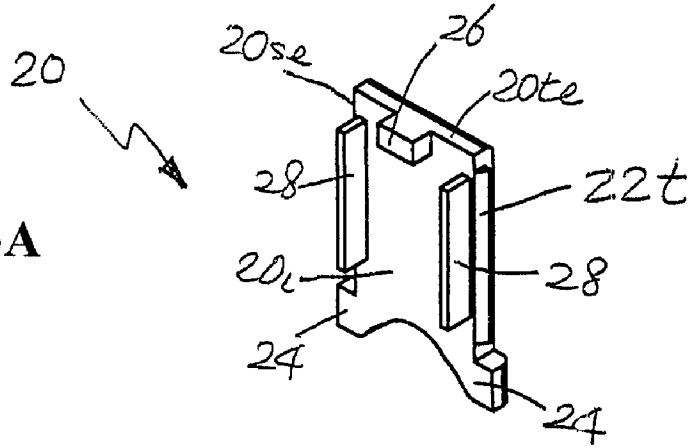
FIG. 3A is a rear perspective view of a front housing of the locking device.
Figure 3C:
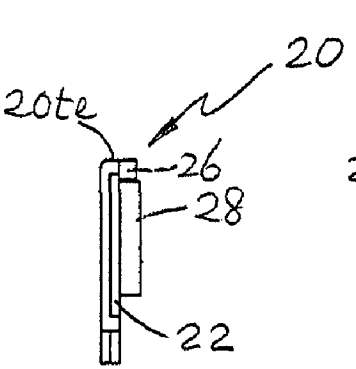
FIG. 3C is a side view of the front housing of shown in FIG. 3A.
Figure 3D:
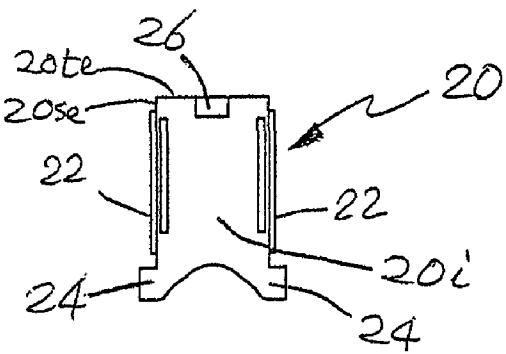
FIG. 3D is the rear view of the front housing shown in FIG. 3A.
Figure 3B:
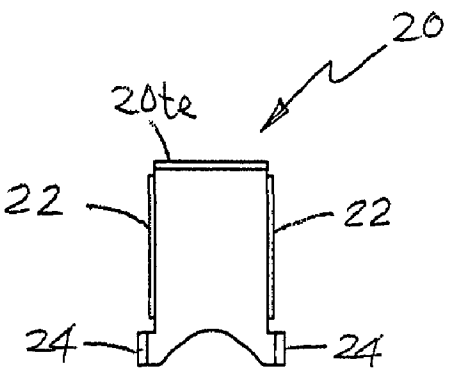
FIG. 3B is the front view of the front housing shown in FIG. 3A.

In the example shown in FIG. 3A, the front housing 20 of the locking device 1 has a head portion 26 formed on the inner surface 20*i* and under the top edge 20*te* of the front housing 20. When the front and rear housings 10, 20 are assembled together, the head portion 26 can fit into the cutout 12*c* in the rear housing 10. The head portion 26 thus facilitates in retaining the screw shaft 34 in position in the assembled locking device 1.

Figure 7C:
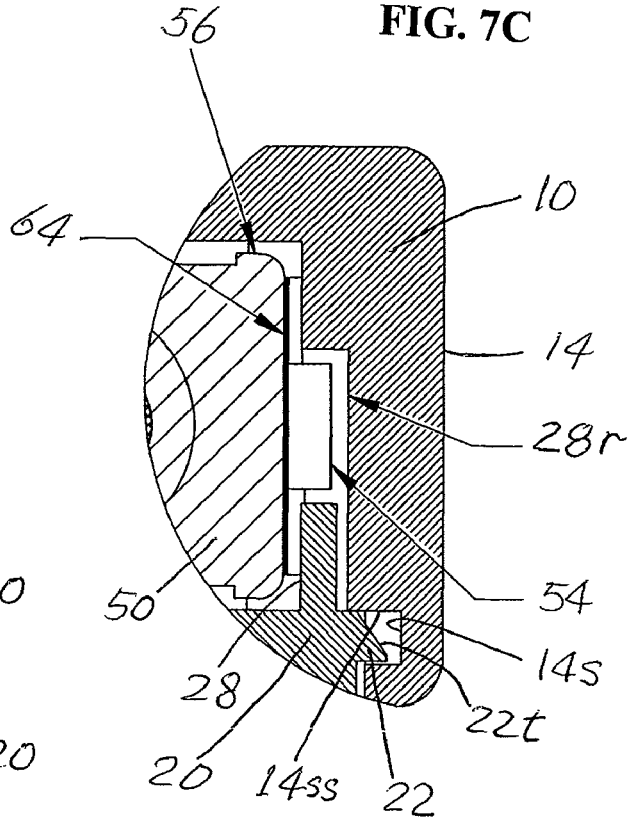
FIG. 7C is a partial enlarged view of the assembled housing unit shown in FIG. 7B.

The front housing 20 of the locking device 1 can have rear extensions 28 extending from the inner surface 20*i* near the side edges 20*se*. The rear extensions 28 on the front housing 20 are sized and positioned to extend into the concave portions 14*a* in the sidewalls 14 of the lower housing portion 10*b* when the front and rear housings 10, 20 are assembled together, as is shown in FIGS. 7B and 7C. The rear extensions 28 and the respective rear edges 14*re* of the concave portions 14*a* can thus form axial recesses 28*r* in the respective sidewalls 14 of the rear housing 10. The configuration of such axial recess 28*r* is best illustrated in FIG. 7C and will be discussed in great details below.

FIGS. 4A to 4E show various views of the adjustment knob 40 of the locking device 1. The adjustment knob 40 is formed with a receiving area 42 and a receiving hole 44 communicated with each other in an axial direction. The receiving area 42 is formed to accommodate the screw head 32 while the receiving hole 44 allows the screw shaft 34 to pass through in the axial direction. In one example, the receiving area 42 can have a profiled circumference 42*p* to match that of the screw head 32. For example, the receiving area 42 can have a hexagon circumference 42*p* to accommodate a hexagon screw head 32.

The adjustment knob 40, the receiving area 42, and/or the receiving hole 44 can be formed to have a predetermined height or depth. For example, the height or depth can be determined so that the combination of the adjustment knob 40 and the screw head 32 fit inside the receiving area 42 and have a height substantially the same as that of the interior of the top housing portion 10*t*. In one example, the adjustment knob 40 can have a height to fit inside the top housing portion 10*t* and substantially occupy its interior height. In another example, the depth of the receiving area 42 can be the same as or less than the height of the screw head 32 to avoid the screw 30 from freely moving inside the receiving area 42 in an axial direction. In a preferred embodiment, the depth of the receiving area 42 in the adjustment knob 40 is substantially the same as the height of the screw head 32.

In another example, the adjustment knob 40 can have a ring structure 46 formed on a side opposite from the receiving area 42. The ring structure 46 is adapted to fit in the cutout 12*c* in the dividing wall 12 of the rear housing 10, for positioning the adjustment knob 40 in the assembled locking device 1. The interior of the ring structure 46 communicates with the receiving hole 44 and allows the screw shaft 34 to pass therethrough when assembling the locking device 1.

The adjustment knob 40 can be configured in various ways to facilitate its operation. For example, the adjustment knob 40 can be formed with a knurled surface 48 to allow for ease in turning. In another example, not shown, the adjustment knob 40 can be formed to be polygonal or non-circular, such as in a hexagon shape, for easy manipulation of the adjustment knob 40. One skilled in the art will appreciate that additional or alternative mechanism can be employed to serve the same purposes.

Referring back to FIG. 1A, the adjustment mechanism of the locking device 1 includes the block 50. The block 50 is formed with a threaded hole 52 for operably receiving the threaded screw shaft 34 of the screw 30, so that the screw 30 can drive the block 50 during the operation of the locking device 1. The block 50 can be configured in various ways so that, when being driven by the screw 30, the block 50 moves in the axial direction of the locking device 1. For example, the block 50 can be of substantially the same shape as the enclosed chamber 14*i* of the lower housing portion 10*b*, in a radial cross section as is shown in FIG. 7B. The lower housing 10*b* can thus restrict the block 50 from rotating along with the screw shaft 34 when the screw 30 is rotated. In one example, the block 50 can be formed to have a substantially cubicle shape.

Additionally or alternatively, the block 50 can be formed to have one or more block ribs 56 configured to contact the interior surface of the lower housing portion 10*b*, thereby minimizing rotation of the block 50 caused by the rotating screw shaft 34. Such block ribs 56 can effectively reduce the contact area, and thus friction, between the block 50 and the interior surface of the lower housing portion 10*b*. In one example where the block 50 has a substantially cubicle shape, the block ribs 56 can be formed on the axial edges of the block 50, as is illustrated in FIGS. 7B and 7C. One skilled in the art will appreciate that the block ribs 56 can be formed in other form to serve the same purposes.

In addition, the block 50 is configured to carry the securing strap 60 and move the same in the axial direction during the operation of the locking device 1 to enlarge or reduce the size of the loop 5 as needed. For example, the block 50 includes strap supporters 54 configured to attach to, or otherwise receive the ends of the securing strap 60. In one example, the strap supporters 54 have a knob-like structure for insertion in the receiving holes 62 on the securing strap 60.

As explained above, the locking device 1 also includes the securing strap 60 adapted to form a portion of the loop 5, i.e., to at least partially surround a portion of the article to be secured. For example, the securing strap 60 can be bent into a U-shape with legs 66 having end portions 64, with each having one of the receiving holes 62. The receiving holes 62 on the securing strap 60 can be fitted over the respective knob-like strap structures 54 of the block 50 to attach the securing strap 60 to the block 50. If desired, the knob-like structure 54 can be further provided with various surface details to retain the securing strap 60 to the block 50.

The securing strap 60 can be formed of various materials. For example, the securing strap 60 can be formed of a strong flexible material, such as spring steel, plastic or other material that is not readily breakable by hand. When the display article is placed in the loop 5, and the loop is tightened as described above, the securing strap 60 remains surrounding the article until the locking device 1 is unlocked by an authorized personnel. As one skilled in the art will appreciate, other securing elements, such as a securing belt or chain, can be used in addition or in place of the securing strap 60.

FIGS. 5A to 5F show various views of the cap 70 of the locking device 1. The cap 70 has an interior chamber 70*i* that can accommodate the upper housing portion 10*t* and at least part of the lower and front housings 10*b*, 20. In one example, the cap 70 can have a body portion 72*b* shaped to surround the upper housing portion 10*t* and the adjustment knob 40 in the assembled locking device 1. In addition, the cap 70 can have an extension portion 72*e* continuously extending from the body portion 72*b* and shaped to surround the eye fastener 18 on the rear housing 10 and the connecting cable tied around the eye fastener 18. As is depicted by the assembled locking device 1 in FIG. 1B, the cap 70 can conceal the adjustment knob 40, the fastening eye 18, and a part of the connecting cable attached to the eye fastener 18 in the assembled locking device 1, thereby preventing direct access to the adjustment knob 40 and the connection between the connecting cable and the eye fastener 18 for security purposes.

Figure 5F:
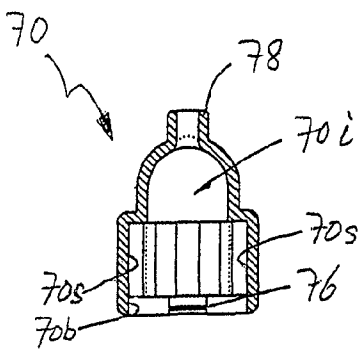
FIG. 5F is another cross-sectional view of the cap taken along line V-V in FIG. 5C.
Figure 5C:
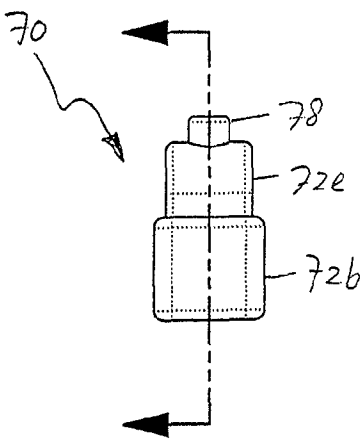
FIG. 5C is a side view of the cap shown in FIG. 5A.
Figure 5A:
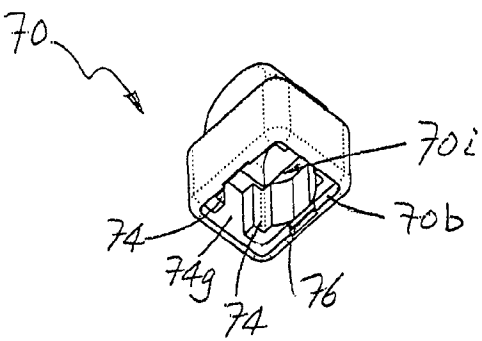
FIG. 5A is a bottom perspective view of a cover or cap of the locking device.
Figure 5B:
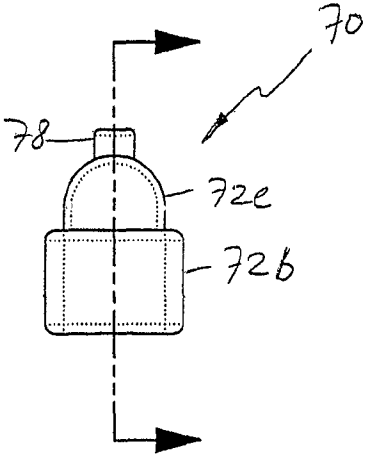
FIG. 5B is the front view of the cap shown in FIG. 5A.
Figure 5D:
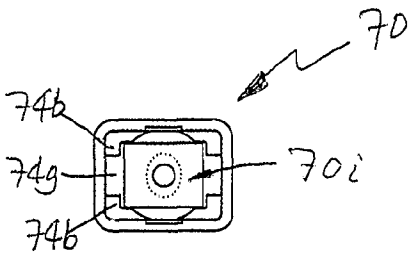
FIG. 5D is the bottom view of the cap shown in FIG. 5A.

The cap 70 of the locking device 1 can be configured to join one or both of the front and rear housings 10, 20. In one embodiment, the interior of the cap 70 is configured to achieve such purposes. As is best shown in FIG. 5A, each interior sidewall 70*s* of the cap 70 can be formed with inserts 74, which are spaced from each other to form a gap 74*g* therebetween. Each gap 74*g* is configured to accommodate part of the upper housing portion 10*t* of the rear housing 10, as will be better understood in connection with FIG. 1A. When the cap 70 is fit over the upper housing portion 10*t* of the rear housing 10, the inserts 74 inside the cap 70 refrain the cap 70 from lateral movement in relation to the front and rear housings 10, 20.

In addition, each insert 74 on the interior sidewalls 70*s* terminates at a bottom surface 74*b*. In one example, the bottom surfaces 74*b* of the inserts 74 can rest on the exposed dividing wall 12 when the cap 70 is fit over the front and rear housings 10, 20. The inserts 74 so formed can further support the cap 70 on the rear housing 10. In the example shown in FIG. 5A, the bottom surfaces 74*b* of the inserts 74 are retracted into the interior chamber 70*i* of the cap 70, resulting in a continuous circumferential inner wall 70*b* at the bottom of the cap 70. When the cap 70 fits over the front and rear housings 10, 20, as is in the assembled locking device 1, the circumferential inner wall 70*b* surrounds and extends beyond the dividing wall 12 of the rear housing 10.

Figure 5E:
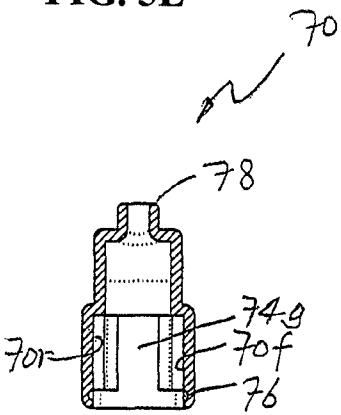
FIG. 5E is a cross-sectional view of the cap taken along line IV-IV in FIG. 5B.

In another example, the cap 70 is formed with one or more indentations 76 for locking onto a ridge formed on the lower housing portion 10*b* and thereby secured thereto. As FIGS. 5E and 5F show, the indentations 76 are located on the circumferential inner wall 70*b*. When the cap 70 fits over the front and rear housings 10, 20 and the circumferential inner wall 70*b* extend over and beyond the dividing wall 12, one of such indentations 76 engages the ridge 19 formed on the rear housing 20.

A port 78 is formed on the extension portion 72*e* of the cap 70 and communicates with the interior chamber 70*i* of the cap 70. The port 78 thus provides a passage for the connecting cable to pass through and extend to the outside of the cap 70. The other end of the connecting cable can then be secured to a fixture, such as a display counter or shelf in a retail store. In the example, the port 78 is positioned on the top portion of the cap 70. As one skilled in the art will appreciate, the port 78 can be formed at other locations on the cap 70.

The locking device 1 can employ additional optional components to improve the various functions. In the example of FIG. 1A, a gripping device 90, such as a rubber gripper, can be used to enhance gripping of the article located inside the fastening loop 5 and/or protect the article from being scratched or otherwise damaged. One skilled in the art will appreciate that various other protection-type elements, such as pads can also be used as the gripping device 90.

The various components of the locking device 1 can formed in various ways. For example, these components can be molded into the desired configuration. Various materials can be used to form these components. These materials include but are not limited to metal and plastics. In one example, the front and rear housings 10, 20, the adjustment knob 40, the block 50, and the cap 70 can be molded from a thermoplastic material, such as acrylonitrile butadiene styrene (ABS). One skilled in the art will appreciate that the components of the locking device 1 can be formed by other methods and/or of other materials.

Figure 7A:
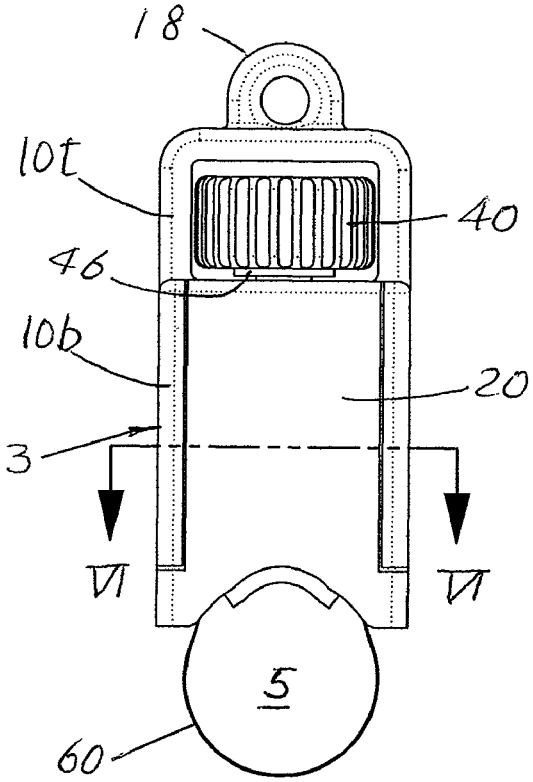
FIG. 7A is the front view of the assembled housing unit.

An example for assembling the various components of the locking device 1 will be described in connection with FIGS. 6A and 6B showing partially assembled locking device 1 in respectively locked and unlocked positions and with FIGS. 7A to 7C showing an assembled housing unit 3.

As can be seen from FIGS. 6A and 6B, the screw 30, the adjustment knob 40, the block 50, and the securing strap 60 can be first interconnected with one another as described above. For example, the screw 30 is made to pass through the receiving area 42 and receiving hole 44, which receive respectively the screw head 32 and screw shaft 34. The block 50 is then screwed onto the threaded screw shaft 34 and carries the receiving holes 62 in the securing strap 60 on the strap supporters 54.

These interconnected adjustment components 30, 40, 50 are then fit inside the rear housing 10 so that the adjustment knob 40 is received in the upper housing portion lot, while the screw shaft 34 and the attached block 50 are received in the lower housing portion 10*b*. The securing strap 60 is made to partially surround the base 16 of the lower housing portion 10*b* so that the legs 66 are fit in the gaps 16*g* between the base 16 and the respective sidewalls 14.

The securing strap 60 and the bottom surface 16*b* of the base 16 form a fastening loop 5. In one example, the fastening loop 5 expands or contracts. For example, the adjustment knob 40 can be turned to either raise or lower the block 50, which in turn raises or lowers the securing strap 60 to decrease or increase, respectively, the size of loop 5.

After the interconnected components 30, 40, 50, 60 are placed inside the rear housing 10, the front housing 20 is brought to and closes the rear housing 10 to form an enclosed housing unit 3, as is shown in FIGS. 7A to 7C. When assembling the front and rear housings 10, 20, the head portion 26 on the front housing 20 is inserted in the cutout 12*c* in the dividing wall 12. Additionally or alternatively, the rear extensions 28 on the front housing 20 are inserted into the respective concave portions 14*a* on the sidewalls 14, as is shown in FIGS. 7B and 7C. The front and rear housings 10, 20 are then pressed toward each other until the inserts 22 on the front housing 20 are forced into the axial slots 14*s* on the sidewalls 14 of the rear housing 10. The front and rear housings 10, 20 are thus joined to each other to form an enclosed housing unit 3. In the example shown in FIG. 7B, the assembled housing unit 3 can have a smooth and continuous exterior without clear distinction between the front and rear housings 10, 20 so that any seam between the front and rear housings 10, 20 will be difficult to discern.

In the assembled housing unit 3 as shown in FIGS. 7B and 7C, the rear extensions 28 of the front housing 20 and the concave portions 14*a* on the rear housing 10 form axial recesses 28*r* in the respective sidewalls 14 of the rear housing 10. In one example, such axial recesses 28*r* can retain the strap supporters 54 therein and/or cause the block 50 to move in an axial direction during the operation of the locking device 1. For example, when the threaded screw shaft 34 is rotated inside the threaded hole 52 in the block 50, the block 50 is restricted from rotation by the strap supporters 54 received in the axial recesses 28*r*. The block 50 thus moves in an axial direction of the locking device 1, thereby adjusting the securing strap 60 to loosen or tighten the fastening loop 5.

Additionally or alternatively, the axial recesses 28*r*, together with the sidewalls 14 of the rear housing 10 and the rear extensions 28 of the front housing 20, can assist in retaining the end portions 64 of the securing strap 60 on the strap supporters 54 of the block 50 during the operation of the locking device 1. In the example best shown in FIG. 7C, the end portion 64 of the securing strap 60 is sandwiched and held between the block 50 and the inner surfaces of a corresponding sidewall 14 of the rear housing 10 and a corresponding rear extension 28 of the front housing 20. The receiving hole 62 on the end portion 64 of the securing strap 60 is received by a corresponding strap supporter 54, which extends into a corresponding axial recess 28*r*. Accordingly, the end portion 64 of the securing strap 60 can be retained on the strap supporter 54 on the block 50 and prevented from accidentally falling off the strap supporter 54 to consequently disengage with the strap supporter 54 on the block 50.

The connecting cable 80 can be applied and secured to the housing unit 3 by various known methods. In the example shown in FIGS. 6A and 6B, one cable end 82 of the connecting cable 80 is tied to an eye fastener 18. One skilled in the art will appreciate that other methods can be employed to connect the connecting cable 80 to the housing unit 3.

The cap 70 is then assembled with the enclosed housing unit 3. For example, the cap 70 is brought to cover the upper housing portion 10*t* of the enclosed housing unit 3. In one example, the upper housing portion 10*t* is fit in the gap 74*g* between the inserts 74 inside the cap 70 to prevent the cap 70 from lateral movement in relation to the housing unit 3. The cap 70 and the housing unit 3 are brought toward each other until the bottom surfaces 74*b* of the inserts 74 in the cap 70 rest on the exposed upper surface 12*e* of the dividing wall 12 on the rear housing 10. In one example, the cap 70 and the housing unit 3 are pressed against each other to engage the ridge and indentation mechanism 19, 76 formed on respectively the housing unit 3 and the cap 70 to lock the cap 70 onto the housing unit 3.

In one example, the cap 70 is movably tethered to the connecting cable 80. For example, the free cable end 84 of the connecting cable 80 is threaded through opening 78 and secured to extension portion 72*e*, such as by a knot. The cap 70 is then moved to the housing unit 3 and secured thereto as explained above.

The operation of the locking device 1 will now be described in connection with FIGS. 6A and 6B. First, the cap 70 is released from the housing unit 3 to provide access to the adjustment knob 40. It is noted that the cap 70 remains movably attached to an end of the cable 80. In the unlocked position shown in FIG. 6A, the adjustment knob 40 has been turned in an unlock direction (e.g. counter-clockwise, etc.) to unlock the locking device 1. In such an unlocked position, the block 50 is lowered toward the base 16 so that the securing strap 60 expands the loop 5. The extended fastening loop 5 can allow insertion or release of a display article, such as a pen, etc. In other words, the expansion of loop 5 allows an existing display article to be removed from the loop and another display article to be inserted.

After the article is placed in the extended fastening loop 5, the adjustment knob 40 is turned in an opposite direction (e.g., a clockwise direction), whereby the block 50 is moved in a direction toward the top housing portion 10*t* by the rotating screw shaft 34. The rising block 50 in turn causes the securing strap 60 to retract into the housing unit 3, thereby reducing the size of the fastening loop 5 until it tightens around the article and secures the same to the locking device 1. The fastening loop 5 can be adjusted as needed to accommodate articles of different sizes.

After the article is secured in the fastening loop 5, the cap 70 is then placed on the housing unit 3 to at least enclose the upper housing portion 10*t*, and additional parts of the lower housing portion 10*b* and front housing 20. For example, the cap 70 is fit over the upper housing portion 10*t* so that it is received between each pair of the inserts 74 on a respective interior sidewall 70*s* of the cap 70. When the cap 70 reaches the lower housing portion 10*b* and the front housing 20, at least one of the indentations 76 on the interior front and rear walls 70*f*, 70*r* snap into the corresponding ridge 19 formed on the rear housing 10 to thereby secure the cap 70 to the housing unit 3 and prevent customer access to the adjustment knob 40 while securing the fastening loop 5 to the article.

In addition, the locking device 1 can be attached to a fixture, such as a display shelf or counter via the connecting cable 80. The length of the connecting cable 80, on the other hand, allows the locking device 1 and the attached article to freely move within the restricted area.

The cap of the locking device 1 deters or prevents unauthorized access to one or more of the adjustment components 30, 40, 50 inside the housing unit 3 formed by the front and rear housings 10, 20 and/or to the connection between the eye fastener 18 and the connecting cable. Thus, the article on display can be maintained in the display area while the threat of pilfering is reduced.

If the merchant intends to remove the article on display from the locking device, the merchant can operate the locking device 1 to remove the cap 70 from the housing unit 3. In one example, the front and rear housings 10, 20 can be squeezed against each other to release the ridge and indentation mechanism 19, 76. In another example, the cap 70 can be tilted toward the front housing 20 to release the ridge 19 from the indentation 76 on the cap 70. The cap 70 can subsequently be separated from the front and rear housings 10, 20 to expose the adjustment knob 40. The merchant can then turn the adjustment knob 40 to adjust the securing strap 60 to loosen or tighten the fastening loop 5, as discussed above.

Although the above examples of the locking device 1 are described in connection with a pen, the locking device 1 herein can be used for securing various articles, including articles with an open ended rod structure. Exemplary articles can include but are not limited to pens, sporting rackets, golf clubs, brushes, and hand tools (e.g., hammers, screwdrivers, wenches, etc.).

While there have shown and described and pointed out fundamental novel features of the invention as applied to a preferred embodiment thereof, it will be understood that various omissions and substitutions and changes in the form and details of the devices illustrated, and in their operation, can be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention can be incorporated in any other disclosed or described or suggested form or embodiment as a general matter of design choice. It is the intention, therefore, to be limited only as indicated by the scope of the claims appended hereto.

What is claimed is:

1. A locking device for securing an article intended for display comprising:

a housing unit;

an adjustment mechanism supported inside the housing unit;

a securing strap attached to the adjustment mechanism and partially extending outside the housing unit;

a cap configured to releasably lock to the housing unit to contain the adjustment mechanism;

wherein the securing strap and the housing unit form an enclosed loop outside of the housing unit for receiving the article intended for display and for selectively locking and unlocking the article to the housing unit;

wherein, when the cap is locked to the housing unit, the cap prevents access to the adjustment mechanism; and wherein the adjustment mechanism is configured to axially displace the securing strap between a locking position and an unlocking position.

2. The locking device of claim 1, wherein the housing unit is divided into an upper housing portion and a lower housing portion by a dividing wall, each of the upper and lower housing portions supporting part of the adjustment mechanism.

3. The locking device of claim 2, wherein the cap locks to the lower housing portion and conceals the upper housing portion.

4. The locking device of claim 1, wherein the housing unit comprises first and second housings separable from each other.

5. The locking device of claim 4, wherein the first separable housing comprises a dividing wall that divides the first separable housing into an upper portion and a lower portion, the dividing wall has a cutout, the second separable housing comprises a head portion configured to fit in the cutout on the dividing wall when the first and second separable housings are joined to each other.

6. The locking device of claim 1, wherein the adjustment mechanism comprises:

a screw having a head portion and threaded screw shaft;

an adjustment knob formed with a receiving area, which is recessed from a top surface of the adjustment knob for receiving the head portion of the screw, and a through hole allowing the threaded screw shaft to freely pass through; and a block formed with a pair of supports, which are located on opposite sides of the block for attaching opposite ends of the securing strap, and a threaded hole for cooperating with the threaded screw shaft;

whereby, when the adjustment knob is rotated, the block displaces the securing strap between the locking position and the unlocking position.

7. The locking device of claim 6, wherein the housing unit comprises an upper housing portion and a lower housing portion divided by a dividing wall and receiving the adjustment knob and the block, respectively.

8. The locking device of claim 7, wherein the upper housing portion is partially open to expose part of the dividing wall, whereby the adjustment knob in the upper housing portion is concealed by the cap and accessible when the cap is removed from the housing unit.

9. The locking device of claim 7, wherein the dividing wall has a cutout configured to accommodate the threaded screw shaft, the cutout extending from a free edge of the dividing wall for receiving the threaded screw shaft.

10. The locking device of claim 7, wherein the lower housing portion comprises opposite sidewalls, the opposite sidewalls each being formed with a concave portion inside the enclosed chamber for guiding the pair of supports on the block during a locking or unlocking operation of the locking device.

11. The locking device of claim 10, wherein the lower housing portion comprises first and second separable housings forming an enclosed chamber, the first separable housing being formed with the opposite sidewalls, the second separable housing comprising a pair of rear extensions extending into the respective concave portions on the first separate housing, whereby the rear extensions and respective rear edges of the concave portions form axial recesses in the respective sidewalls of the first separable housing for guiding the pair of supports on the block during the locking or unlocking operation of the locking device.

12. The locking device of claim 10, wherein the lower housing portion comprises first and second separable housings, the first separable housing being formed with the opposite sidewalls, and wherein the opposite sidewalls on the first separable housing have respective free end portions extending beyond the dividing wall for a distance substantially the same as a thickness of the second separable housing, whereby the lower housing portion formed has a smooth and continuous exterior surface after the first and second separable housings are joined to each other.

13. The locking device of claim 10, wherein the lower housing portion comprises first and second separable housings, the opposite sidewalls have respective free end portions, which are thinner than the sidewalls at the concave portions to form a stepped surface on the first separable housing, whereby the second separable housing rests against the stepped surface on the first separable housing, when two separable housings are joined to each other.

14. The locking device of claim 7, wherein the lower housing portion comprises two separable housings with complementary connectors for releasably joining the two separate housings to each other to form the housing unit as a single piece.

15. The locking device of claim 7, wherein the lower housing portion further comprises a base portion configured to support the screw, the base portion being spaced away from opposite sidewalls of the lower housing portion and forming respective gaps allowing the securing strap to pass therethrough.

16. The locking device of claim 15, wherein the base portion form part of the enclosed loop.

17. The locking device of claim 1, wherein the cap comprises a plurality of inserts formed on an interior sidewall of the cap, the plurality of inserts being spaced from each other, wherein, when the cap is locked onto the housing unit, the plurality of inserts are positioned around the housing unit to refrain the cap from lateral movement in relation to the housing unit.

18. The locking device of claim 17, wherein the plurality of inserts are retracted into a cap chamber from an opening of the cap chamber to form a continuous circumferential inner wall at the opening of the cap chamber, wherein, when the cap is locked onto the housing unit, the plurality of inserts rest on a dividing wall of the housing unit, the dividing wall dividing the housing unit into upper and lower housing portions; and wherein the continuous circumferential inner wall surrounds a portion of the lower housing portion.

19. The locking device of claim 1, wherein the securing strap is formed of a flexible material.

20. The locking device of claim 1, further comprising a connecting cable having a first end attachable to the housing unit and a second end exiting the cap through a port formed in the cap.

* * * * *